US007832984B2

(12) United States Patent
Harman

(10) Patent No.: US 7,832,984 B2
(45) Date of Patent: Nov. 16, 2010

(54) HOUSING FOR A CENTRIFUGAL FAN, PUMP, OR TURBINE

(75) Inventor: Jayden David Harman, San Rafael, CA (US)

(73) Assignee: Caitin, Inc., Petaluma, CA (US)

( * ) Notice: Subject to any disclaimer, the term of this patent is extended or adjusted under 35 U.S.C. 154(b) by 133 days.

(21) Appl. No.: 12/221,711

(22) Filed: Aug. 5, 2008

(65) Prior Publication Data

US 2009/0035132 A1 Feb. 5, 2009

Related U.S. Application Data

(63) Continuation of application No. 11/496,013, filed on Jul. 28, 2006, now Pat. No. 7,416,385, which is a continuation of application No. PCT/AU2005/000116, filed on Jan. 31, 2005.

(60) Provisional application No. 60/540,513, filed on Jan. 30, 2004, provisional application No. 60/608,597, filed on Sep. 11, 2004, provisional application No. 60/624,669, filed on Nov. 2, 2004.

(51) Int. Cl.
*F04D 29/40* (2006.01)

(52) U.S. Cl. ..... 415/204; 415/224

(58) Field of Classification Search ..... 415/207, 415/224, 224.5, 212.1

See application file for complete search history.

(56) References Cited

U.S. PATENT DOCUMENTS

| | | | | |
|---|---|---|---|---|
| 11,544 | A * | 8/1854 | Andrews | 415/207 |
| 700,785 | A | 5/1902 | Kull | |
| 794,926 | A | 7/1905 | Crawford | |
| 871,825 | A | 11/1907 | Schupmann | |
| 879,583 | A | 2/1908 | Pratt | |
| 943,233 | A | 12/1909 | Boyle | |
| 965,135 | A | 7/1910 | Gibson | |
| 969,101 | A | 8/1910 | Gibson | |
| 1,023,225 | A | 4/1912 | Shlosberg | |
| 1,272,180 | A | 7/1918 | Andresen | |
| 1,353,478 | A | 9/1920 | Jeffries, Sr. | |
| 1,396,583 | A | 11/1921 | Krafve | |
| 1,505,893 | A | 8/1924 | Hunter et al. | |
| 1,658,126 | A | 2/1928 | Jehle | |

(Continued)

FOREIGN PATENT DOCUMENTS

| | | |
|---|---|---|
| AU | B-62946/96 | 2/1997 |

(Continued)

OTHER PUBLICATIONS

Merriam-Webster Online Dictionary. http://www.merriam-webster.com/dictionary/spiral. Accessed Feb. 23, 2010.*

(Continued)

*Primary Examiner*—Richard Edgar
(74) *Attorney, Agent, or Firm*—Carr & Ferrell LLP

(57) ABSTRACT

A housing for a blower, fan or pump or turbine, the housing adapted to be associated with a rotor adapted in use to cooperate with fluid flowing through the housing wherein the housing comprises a shroud for guiding the fluid moving in association with the rotor, the rotor having at least one vane adapted to cooperate with the fluid to drive or to be driven by the fluid, wherein the shroud is configured to promote vortical flow of the fluid through the housing.

19 Claims, 13 Drawing Sheets

U.S. PATENT DOCUMENTS 1,667,186 A 4/1928 Bluehdorn
1,709,217 A 4/1929 Hamilton
1,713,047 A 5/1929 Maxim
1,729,018 A 9/1929 Siders
1,756,916 A 4/1930 Stranahan
1,785,460 A 12/1930 Schlotter
1,799,039 A 3/1931 Conejos
1,812,413 A 6/1931 Reynolds
1,816,245 A 7/1931 Wolford
1,872,075 A 8/1932 Dolza
1,891,170 A 12/1932 Nose
1,919,250 A 7/1933 Olson
2,068,686 A 1/1937 Lascroux
2,139,736 A 12/1938 Durham
2,165,808 A 7/1939 Murphy
2,359,365 A 10/1944 Katcher
2,879,861 A 3/1959 Belsky et al.
2,908,344 A 10/1959 Maruo
2,912,063 A 11/1959 Barnes
2,958,390 A 11/1960 Montague
3,066,755 A 12/1962 Diehl
3,076,480 A 2/1963 Vicard
3,081,826 A 3/1963 Loiseau
3,082,695 A 3/1963 Buschhorn
3,215,165 A 11/1965 Broadway
3,371,472 A 3/1968 Krizman, Jr.
3,407,995 A * 10/1968 Kinsworthy ..... 415/206
3,584,701 A 6/1971 Freeman
3,692,422 A 9/1972 Girardier
3,800,951 A 4/1974 Mourlon et al.
3,918,829 A 11/1975 Ito
3,927,731 A 12/1975 Lancaster
3,940,060 A 2/1976 Viets
3,957,133 A 5/1976 Johnson
3,964,841 A 6/1976 Strycek
4,050,539 A 9/1977 Kashiwara et al.
4,182,596 A * 1/1980 Wellman ..... 415/207
4,206,783 A 6/1980 Brombach
4,211,183 A 7/1980 Hoult
4,225,102 A 9/1980 Rao
4,299,553 A 11/1981 Swaroop
4,317,502 A 3/1982 Harris et al.
4,323,209 A 4/1982 Thompson
4,331,213 A 5/1982 Taniguchi
4,505,297 A 3/1985 Leech et al.
4,533,015 A 8/1985 Kojima
4,540,334 A 9/1985 Stähle
4,579,195 A 4/1986 Nieri
4,644,135 A 2/1987 Daily
4,679,621 A 7/1987 Michele
4,685,534 A 8/1987 Burstein et al.
4,699,340 A 10/1987 Rethorst
4,834,142 A 5/1989 Johannessen
4,993,487 A 2/1991 Niggemann
4,996,924 A 3/1991 McClain
5,010,910 A 4/1991 Hickey
5,040,558 A 8/1991 Hickey et al.
5,052,442 A 10/1991 Johannessen
5,058,837 A 10/1991 Wheeler
5,100,242 A 3/1992 Latto
5,139,215 A 8/1992 Peckham
5,181,537 A 1/1993 Powers
5,207,397 A 5/1993 Ng et al.
5,220,955 A 6/1993 Stokes
5,249,993 A 10/1993 Martin
5,261,745 A 11/1993 Watkins
5,312,224 A 5/1994 Batchelder et al.
5,337,789 A 8/1994 Cook
5,382,092 A 1/1995 Okamoto et al.
5,624,229 A * 4/1997 Kotzur et al. ..... 415/204
5,661,638 A 8/1997 Mira
5,741,118 A 4/1998 Shinbara et al.
5,787,974 A 8/1998 Pennington
5,844,178 A 12/1998 Lothringen
5,891,148 A 4/1999 Deckner
5,934,612 A 8/1999 Gerhardt
5,934,877 A 8/1999 Harman
5,943,877 A 8/1999 Chen
5,954,124 A 9/1999 Moribe et al.
6,050,772 A 4/2000 Hatakeyama et al.
6,179,218 B1 1/2001 Gates
6,241,221 B1 6/2001 Wegner et al.
6,272,679 B1 8/2001 Na
6,273,679 B1 8/2001 Na
6,374,858 B1 4/2002 Hides et al.
6,382,348 B1 5/2002 Chen
6,385,967 B1 5/2002 Chen
6,415,888 B2 7/2002 An et al.
6,604,906 B2 8/2003 Ozeki et al.
6,623,838 B1 9/2003 Nomura et al.
6,632,071 B2 10/2003 Pauly
6,669,142 B2 12/2003 Saiz
6,684,633 B2 2/2004 Jett
D487,800 S 3/2004 Chen et al.
6,702,552 B1 3/2004 Harman
6,817,419 B2 11/2004 Reid
6,892,988 B2 5/2005 Hugues
6,932,188 B2 8/2005 Ni
D509,584 S 9/2005 Li et al.
6,959,782 B2 11/2005 Brower et al.
7,117,973 B2 10/2006 Graefenstein
D539,413 S 3/2007 Parker et al.
2002/0148777 A1 10/2002 Tuszko et al.
2003/0012649 A1 1/2003 Sakai et al.
2003/0190230 A1 10/2003 Ito
2004/0037986 A1 2/2004 Houston et al.
2004/0238163 A1 12/2004 Harman
2004/0244853 A1 12/2004 Harman
2005/0011700 A1 1/2005 Dadd
2005/0155916 A1 7/2005 Tuszko et al.
2005/0269458 A1 12/2005 Harman
2006/0102239 A1 5/2006 Harman
2006/0249283 A1 11/2006 Harman
2007/0025846 A1 2/2007 Harman

FOREIGN PATENT DOCUMENTS

DE 003315258 10/1984
EP 14257 8/1980
EP 0 598 253 A1 5/1994
FR 2534981 4/1984
FR 2666031 A 2/1992
GB 873136 7/1961
GB 2057567 A * 4/1981
GB 2 063 365 A 6/1981
JP 98264 6/1932
JP 98264 B 6/1932
JP 129699 8/1979
JP S54129699 10/1979
JP 05332121 12/1993
JP 00257610 9/2000
JP 2000257610 9/2000
JP D1243052 6/2005
SU 431850 4/1975
SU 858896 12/1979
SU 738566 6/1980
SU 850104 7/1981
SU 1030631 7/1983
TW 565374 3/2002
TW M287387 2/2006
WO WO 81/03201 11/1981
WO WO 87 07048 A 11/1987
WO WO 89 08750 A 9/1989
WO WO 00/38591 7/2000

| | | | |
|---|---|---|---|
| WO | WO 01 14782 | | 3/2001 |
| WO | WO 03/056269 | A1 | 7/2003 |
| WO | WO 03 526228 | A | 7/2003 |
| WO | PCT/AU2004/001388 | | 5/2005 |
| WO | WO 2005/073561 | A1 | 8/2005 |

OTHER PUBLICATIONS

Merriam-Webster Online Dictionary. http://www.merriam-webster.com/dictionary/curve. Accessed Feb. 23, 2010.*

Merriam-Webster Online Dictionary. http://www.merriam-webster.com/dictionary/vortex. Accessed Feb. 23, 2010.*

Merriam-Webster Online Dictionary. http://www.merriam-webster.com/dictionary/vortical. Accessed Feb. 23, 2010.*

Derwent Abstract Accession No. 97-198067/18, JP 09053787 A (Kajima Corp) Feb. 25, 1997.

Derwent Abstract Accession No. 97-546288/50, JP 09264462 A (Sekisui Chem Ind Co Ltd) Oct. 7, 1997.

Derwent Abstract Accession No. 1999-380417/32, JP 11148591 A (TLV Co Ltd) Jun. 2, 1999.

Derwent Abstract Accession No. E6575C/21, SU 687306A (Leningrad Forestry Acad) Sep. 28, 1977.

Derwent Abstract Accession No. N8420 E/42, SU 887876 A (As Ukr Hydromechani) Dec. 7, 1981.

Derwent Abstract Accession No. 85-073498/12, SU 1110986 A (Korolev A S) Aug. 30, 1984.

Derwent Abstract Accession No. 89-075095/10, SU 1418540 A (As Ukr Hydrodynamic) Aug. 23, 1988.

Derwent Abstract Accession No. 91-005279, SU 1560887 A (Sredaztekhenergo En) Apr. 30, 1990.

Derwent Abstract Accession No. 93-375668/47, SU 1756724 A (Odess Poly) Aug. 30, 1992.

Derwent Abstract Accession No. L0015B/47, SE 7803739 A (Ingenjorsfirma Garl) Nov. 5, 1979.

Derwent Abstract Accession No. 87-318963/45, SU 1291726 A (Makeevka Eng Cons) Feb. 23, 1987.

Derwent Abstract Accession No. 99-249047/32, JP 11072104 A (Saito Jidosha Shatai Kogyo KK) Mar. 16, 1999.

Derwent Abstraction Accession No. 89-157673, SU 1437579A (Lengd Kalinin Poly) Nov. 15, 1988.

Patent Abstracts of Japan, Publication No. 2000-168632, Jun. 20, 2000, "Low Air Resistance Vehicle Body Using Vortex Ring."

Karassik et al., "Pump Handbook," published 1976 by McGraw-Hill, Inc.

Dr. Knott, Ron, "The Golden Section Ratio: Phi," Available at http://www.mcs.surrey.ac.uk/Personal/R.Knott/Fibonacci/phi.html (last accessed Oct. 3, 2006).

K. Foster et al., "Fluidics Components and Circuits," Wiley-Interscience, London, 1971, pp. 219-221.

McLarty, W., et al., "Phi Geometry: Impeller & Propeller Design for Fluids Handling," Oct. 1999, Offshore Magazine, pp. 123 (and continued).

The CAD Guidebook, A Basic Manual for Understanding and Improving Computer-Aided Design, Stephen J. Schoonmaker, Marcel Dekker, Inc., New York, 2002.

* cited by examiner

HOUSING FOR A CENTRIFUGAL FAN, PUMP, OR TURBINE

CROSS-REFERENCE TO RELATED APPLICATIONS

The present application is a continuation and claims the priority benefit of U.S. patent application Ser. No. 11/496,013 filed Jul. 28, 2006, now U.S. Pat. No. 7,416,385 which is a continuation and claims the priority benefit of Patent Cooperation Treaty application number PCT/AU2005/000116 filed Jan. 31, 2005, which claims the priority benefit of U.S. provisional patent application Nos. 60/540,513 filed Jan. 30, 2004; 60/608,597 filed Sep. 11, 2004; and 60/624,669 filed Nov. 2, 2004. The disclosure of the aforementioned applications is incorporated herein by reference.

BACKGROUND

1. Field of the Invention

The present invention relates to a housing or chamber for a fan for moving air, pump for inducing fluid flow or torque generator, which is responsive to fluid flow such as a turbine. In particular it is directed to providing an improved housing for such apparatus to improve the efficiency of such devices.

2. Description of the Related Art

Centrifugal fans, blowers, pumps turbines and the like represent approximately half of the world's fan, pump and turbine production each year. As fans or pumps, they are used to produce higher pressure and less flow than axial impellers and fans. They are used extensively where these parameters must be satisfied. They have also been used advantageously where installation limitations might not permit an axial fan to be used.

For example, applications such as domestic exhaust fans require greater flow with a relatively low pressure difference. Such an application would normally be satisfied by an axial type of fan. However, in many cases, a centrifugal fan is used to turn the flow path at right angles so that it can fit into a roof or wall cavity. An axial fan will not fit into the cavity and maintain efficiency. In another example, the exhaust ducting in many buildings is only 3 or 4 inches in diameter. It is impractical to fit an effective high-output axial fan to such a small duct.

While centrifugal fans have been used for a long time, little attention has been given to the design of the housing in which the rotor is retained. Where issues of efficiency and noise are investigated, the designer's attention is given primarily to the impeller. Historically, such housings have not been optimized for: 1. fluid flow drag reduction; 2. noise reduction; 3. adjustment of the pressure/flow relationship. Additionally, the housings of typical centrifugal fans, blowers, pumps turbines and the like cause the incoming fluid to turn sharply before leaving the housing. Such shapes are detrimental to efficient performance of the device overall, often introducing significant turbulence.

In the previous disclosure of the applicant for a Fluid Flow Controller as published in W003056228, the applicant has noted the benefits that can be obtained by allowing fluid to flow in the manner followed in Nature.

SUMMARY OF THE INVENTION

Exemplary housings for a rotor are provided. In some embodiments, a housing includes an inlet portion with a shroud for guiding a fluid moving in association with the rotor, and an outlet portion to exhaust the fluid, the outlet portion extending the shroud from the inlet portion, the shroud expanding axially away from a region of rotation of the rotor, the shroud promoting vortical flow of the fluid through the housing. Such housings may be adapted for an axial rotor, a centrifugal rotor, or a rotor having a profile intermediate to that of an axial rotor and that of a centrifugal rotor.

In some embodiments, a rotor housing may include a shroud enclosing a region of rotation for a rotor, an inlet located on a first portion of the shroud and an outlet located on a second portion of the shroud, the second portion of the shroud being approximately opposed with respect to the first portion of the shroud, wherein an internal surface of the shroud includes a vortical formation that induces a vortical flow in a fluid traversing a fluid pathway between the inlet and the outlet. Such housings may be adapted for an axial rotor, a centrifugal rotor, or a rotor having a profile intermediate to that of an axial rotor and that of a centrifugal rotor.

DETAILED DESCRIPTION

Figure 1:
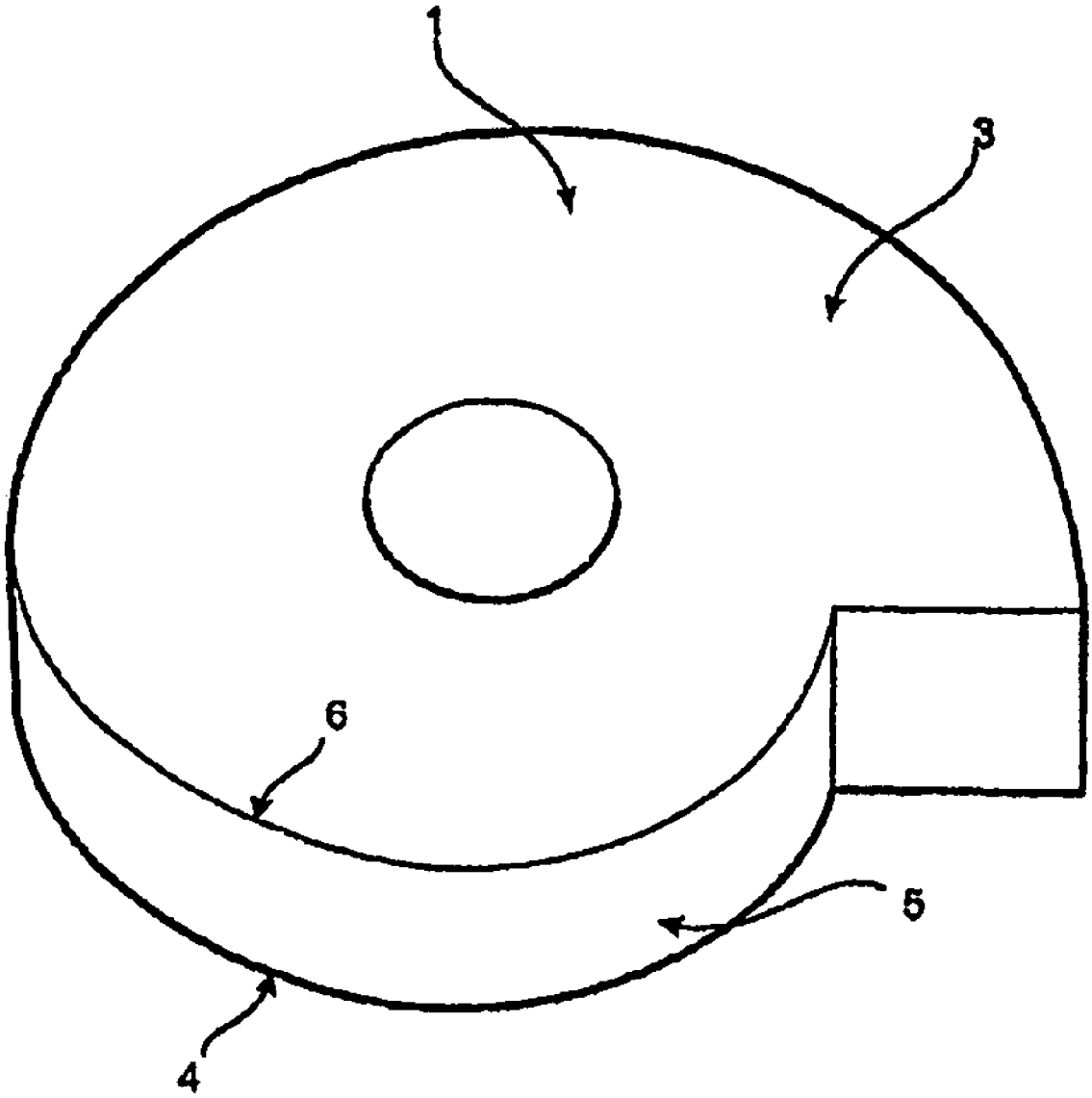
Fig. 1 (PRIOR ART)
FIG. 1 is an isometric diagrammatic representation of a conventional centrifugal fan of the prior art.

Each of the embodiments is directed to a housing for a fan, blower, pump or turbine or the like, which provides an efficient fluid pathway. Hereinafter in this description the term 'fan' will be used generically to refer to any fan, blower, pump, turbine or the like. Where a reference is made to a fan driving or promoting fluid flow, it is to be appreciated that the reference is intended to encompass the situation where the fluid flow drives a rotor of a turbine or the like.

In order to appreciate the differences from the prior art, it is helpful to describe the key features of housings conventionally used for centrifugal fans. An example is illustrated diagrammatically in FIG. 1, which illustrates the key features of a typical arrangement of a housing 1 for a centrifugal fan. Conventionally, such a housing 1 is configured in shape to follow the form of a spiraling arc in two dimensions. It generally comprises a pair of flat-sided panels 3 and 4 disposed apart, parallel to each other and sealed around the perimeter by an edge panel 5 formed from a planar sheet. This creates angled corners 6 at the junction between the top panel 3 and edge panel 5 and similarly between the bottom panel 4 and edge panel 5. Such angled corners induce unwanted turbulence in the fluid passing within the housing.

The shape of a spiraling arc means that a space is provided between the inner surface of the edge panel and the imaginary surface swept by the outer edges of the vanes of the rotor. It will be appreciated that the depth of this space increases progressively from a minimum to a maximum through an angle of 360 degrees. In the vicinity of the maximum depth an outlet is provided to exhaust the fluid.

Each of the embodiments is directed to a housing for a fan, which provides an efficient fluid pathway for fluid passing through the housing. Such fans comprise a rotor which is normally provided with a plurality of vanes or blades although a rotor having a single blade is possible. The vanes are generally configured to provide an outward or radial component of acceleration to the fluid being driven, or in the case of a turbine, the fluid is deflected to provide a radial component to the force applied to the vane and thereby a deflection to the fluid including a radial component.

Nature provides excellent models of optimized streamlining, drag reduction, and noise reduction. Any biological surface grown or eroded to optimize streamlining has no angled corners and does not make fluid turn at right angles but generally follows the shape of an eddy constructed in accordance with a three-dimensional equiangular or Golden Ratio spiral. The underlying geometry of this spiral is also found in the design of a bird's egg, a snail, and a sea shell.

These spirals or vortices generally comply with a mathematical progression known as the Golden Ratio or a Fibonacci like Progression.

Each of the embodiments, in the greater part, serves to enable fluids to move in their naturally preferred way, thereby reducing inefficiencies created through turbulence and friction which are normally found in housings for centrifugal fans.

Previously developed technologies have generally been less compliant with natural fluid flow tendencies.

It has been found that it is a characteristic of fluid flow that, when it is caused to flow in a vortical motion through a pathway that the fluid flow is substantially non-turbulent and as a result has a decreased tendency to separate or cavitate. It is a general characteristic of the embodiments that the housings described are directed to promote vortical flow in the fluid passing through the housing. It has also been found that vortical flow is encouraged where the configuration of the housing conforms to a two-dimensional or three-dimensional spiral. It has further been found that such a configuration tends to be optimized where the curvature of that spiral conforms substantially or in greater part to that of the Golden Section or Ratio. It is a characteristic of each of the embodiments that the greater proportion of the internal surfaces which form the housing have a curvature which takes a two dimensional or three dimensional shape approaching the lines of vorticity or streak lines found in a naturally occurring vortex. The general form of such a shape is a logarithmic spiral. It has further been found that the performance of the embodiments will be optimized where the curvature of the surfaces of the housing substantially or in the greater part conform to the characteristics of the Golden Section or Ratio. It has further been found that the performance is optimized if any variation in cross-sectional area of the fluid pathway also substantially or in greater part conforms to the characteristics of the Golden Section or Ratio.

It has also been found fluid flow is more efficient if the surfaces over which the fluid flows have a curvature substantially or in greater part correspond to that of the Golden Section. As a result of the reduced degree of turbulence which is induced in the fluid in its passageway through such a fan, the housing according to the various embodiments can be used for conducting fluid with less noise and wear and with a greater efficiency than has previously been possible with conventional housing of equivalent dimensional characteristics.

Figure 2:
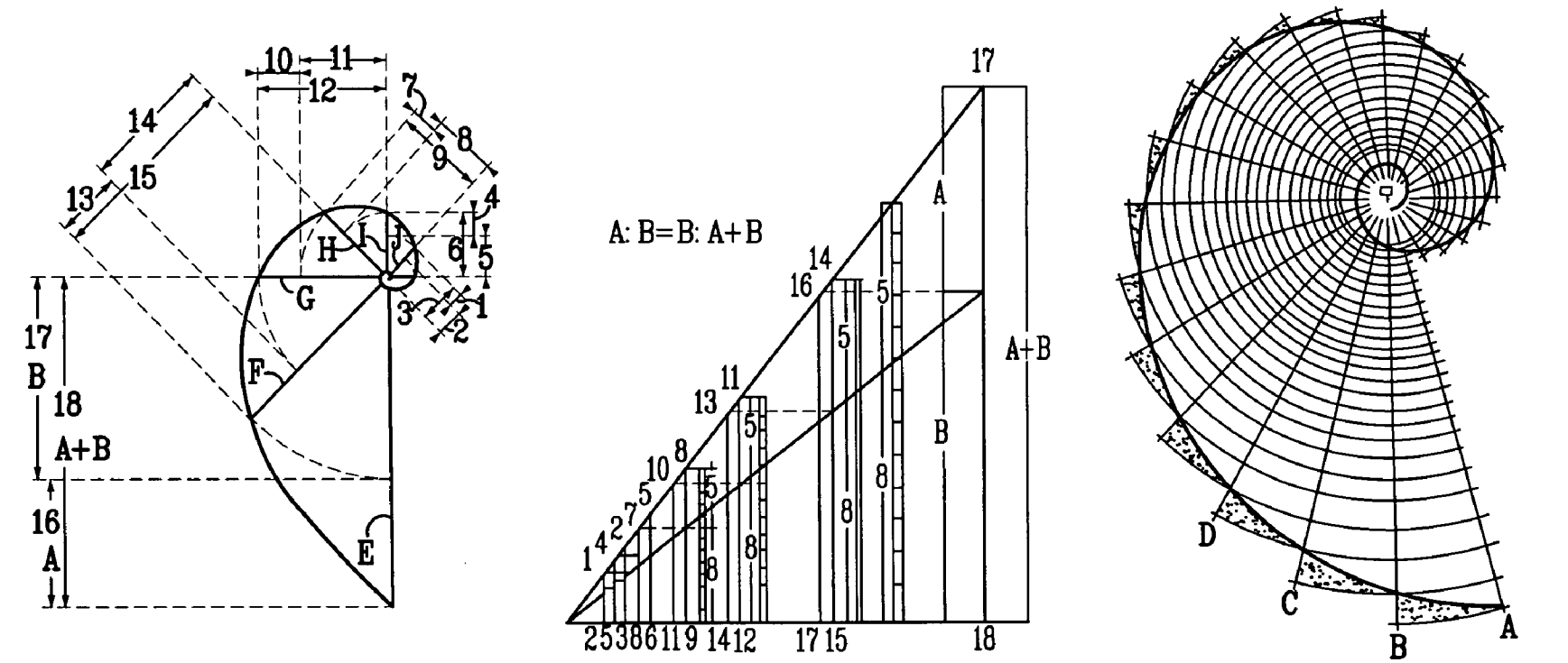
FIG. 2 illustrates graphically the form of the Golden Section.

The greater percentage of the internal surfaces of the housings of each of the embodiments described herein are generally designed in accordance with the Golden Section or Ratio and therefore it is a characteristic of each of the embodiments that the housings provides a fluid pathway which is of a spiraling configuration and which conforms at least in greater part to the characteristics of the equiangular or Golden Section or Ratio. The characteristics of the Golden Section are illustrated in FIG. 2 which illustrates the unfolding of the spiral curve according to the Golden Section or Ratio. As the spiral unfolds the order of growth of the radius of the curve which is measured at equiangular radii (e.g. E, F, G, H, I and J) is constant. This can be illustrated from the triangular representation of each radius between each sequence which corresponds to the formula of a:b=b:a+b which conforms to the ratio of 1:0.618 approximately and which is consistent through out the curve.

This invention may, alternatively, use a snail or sea shell-like shaped flow path housing which may be logarithmic but not a Golden Ratio. Although it is not optimized if it doesn't conform to the three-dimensional Golden Ratio, it will still provide superior performance in its intended use over conventional designs.

Figure 3:
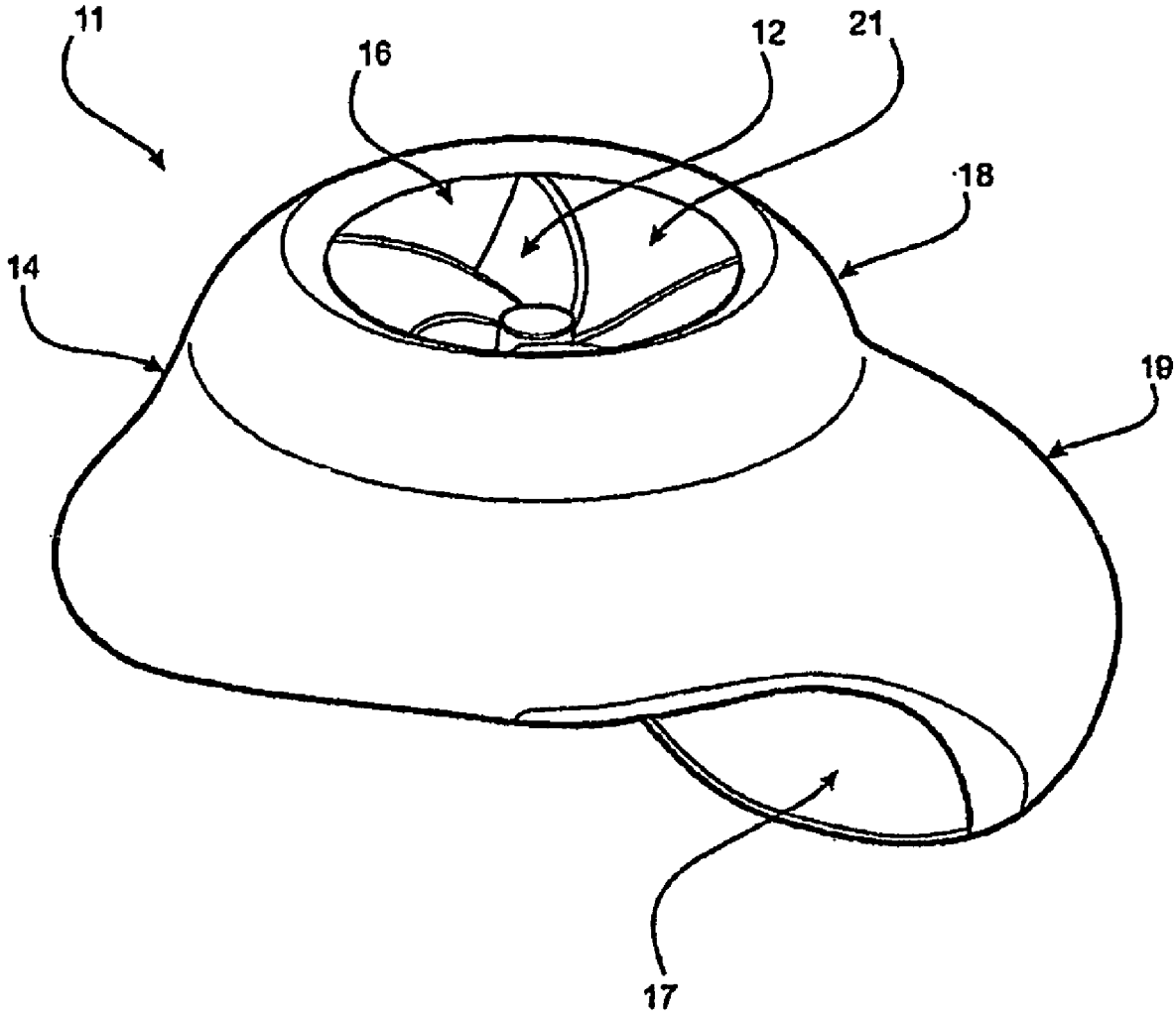
FIG. 3 is an isometric view of a fan according to the first embodiment.
Figure 4:
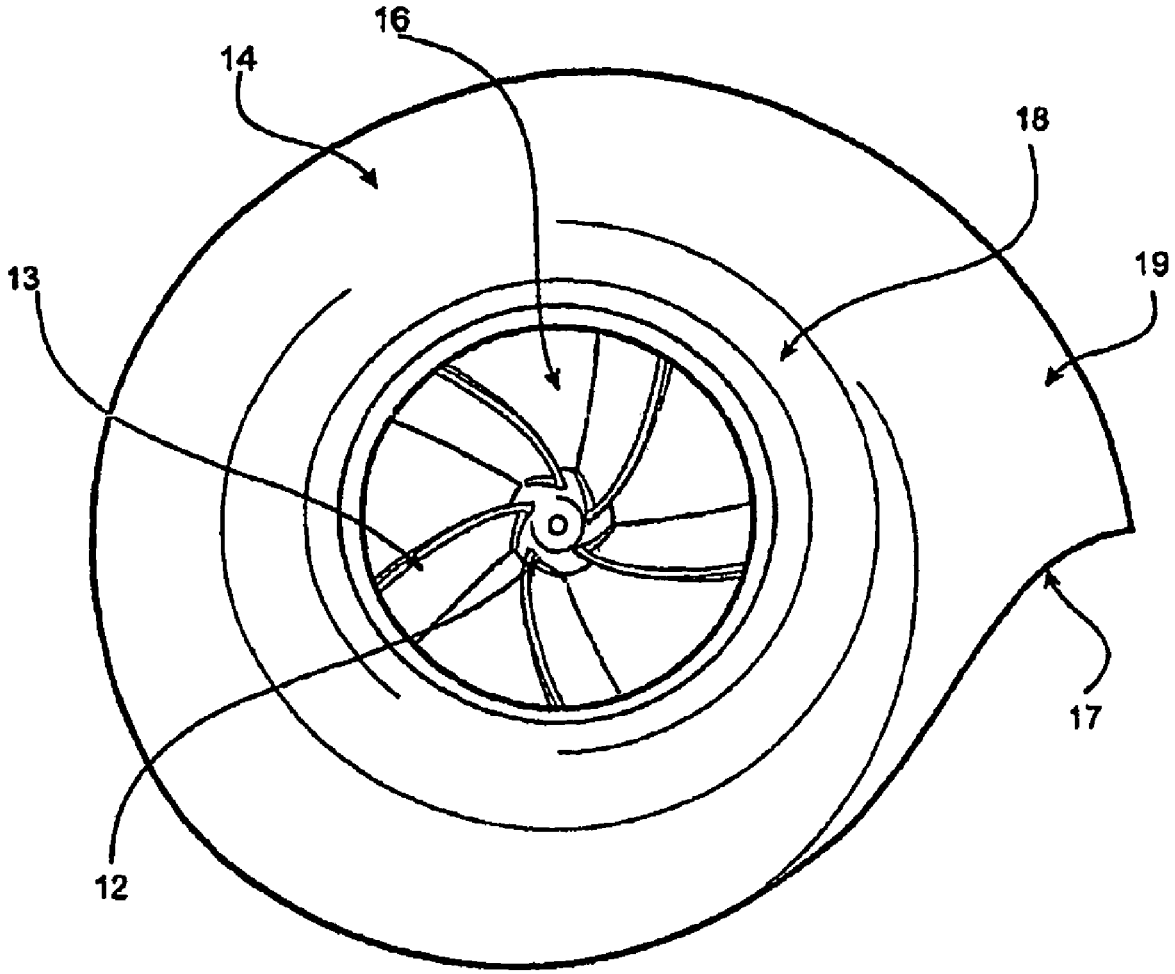
FIG. 4 is a plan view of the fan of FIG. 3.
Figure 5:
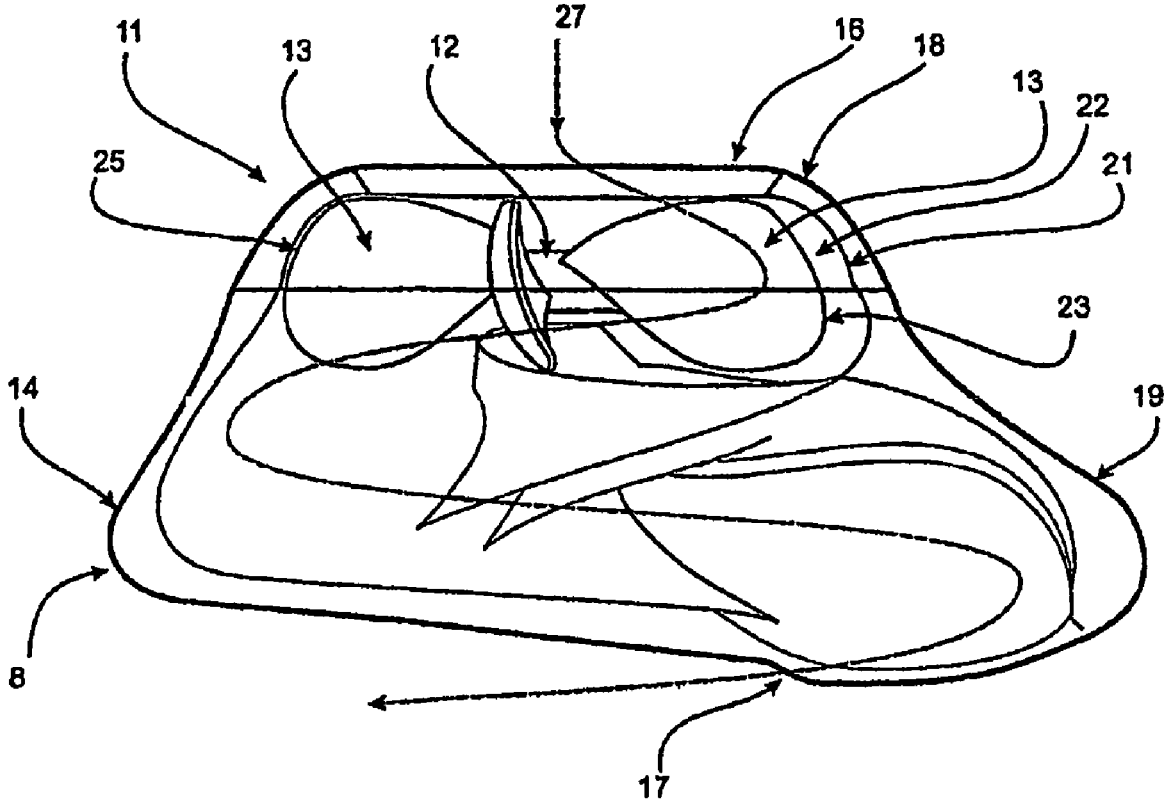
FIG. 5 is a diagrammatic cut-away of the fan of FIG. 3.

A first embodiment of the invention is a fan assembly as shown in FIGS. 3 to 5.

The fan assembly 11 comprises a fan rotor 12 having a plurality of vanes 13, the rotor 12 being adapted to be rotated by an electric motor, not shown. The fan motor is supported within a housing 14 having an inlet 16 and an outlet 17.

The housing 14 has a whirl-shaped form, at least on the internal surfaces which resembles the shape of shellfish of the genus *Trochus*. This shape corresponds generally to the streamlines of a vortex. In the drawings it is to be appreciated that the form indicated on the external surfaces is intended to correspond with the form of the internal surface, although in a real fan the form of the external surface is not of importance to the performance of the fan as such and may be quite different from the internal surfaces. Indeed, the housing might be constructed with an internal shroud which comprises a separate component from the external surface of the housing, and it is to be appreciated that where such a design is undertaken, it is the internal surfaces of the separate shroud which must conform to the principles as described herein.

In the first embodiment, the housing is formed in two portions, 18 and 19. The first of these comprises an inlet portion 18 which includes the inlet 16 and also provides mounting means (not shown) to support the fan motor to which the fan rotor 12 is attached. The inlet portion 18 also acts as a shroud around outer extents of the vanes 13 of the rotor 12 and provides a space 22 between the inner surface 21 of the inlet portion 18 and the imaginary surface swept by the outer edges 23 of the vanes 13 during rotation of the rotor 12. It will be seen in FIG. 5 that the depth of this space increases between a minimum space 25 and a maximum space in a manner akin to the corresponding space in a conventional centrifugal fan. Unlike a conventional centrifugal fan, however, this increase in the space is accompanied by displacement of the fluid path axially away from the region of rotation of the rotor in the first portion 18 towards the outlet 17. The second portion of the housing 14 comprises an outlet shroud 19 extending the flow path in a continuous manner from the first portion. In the outlet shroud 19, the inner surface of the shroud 19 continues to expand while the fluid path is displaced axially. As a result, a generally vortically shaped fluid path is provided which urges fluid flowing through the housing 14 to adopt a vortical flow pattern, as indicated by the dotted line 27 in FIG. 5. Such a flow pattern is of higher efficiency and lower noise than for a comparable conventional fan. In addition, by being spun into vortical flow, the fluid may be urged to be redirected in a generally transverse direction relative, to the incoming flow without requiring an abrupt and turbulent change in flow direction. This also improves efficiency and reduces noise.

As mentioned earlier, while a housing having a generally vortical internal form can be expected to provide significant improvements in higher efficiency and reduced noise, the benefits will be optimized by configuring the housing to have a vortical form in the nature of a three dimensional equiangular spiral or "Golden-Section" spiral. Such a shape should have the internal surfaces configured to have a curvature conforming to the Golden Section. Such a shape will conform with the natural flow tendencies of fluids, thereby further improving efficiency.

It is to be appreciated that the configuring of the housing to be in two portions is to provide ease of manufacture, assembly and maintenance, only. The two portions of such a housing may be held together by releasable clasping means such as clips (not shown), or may include cooperating flanges, bayonet fastenings, or other suitable joining means.

Figure 6:
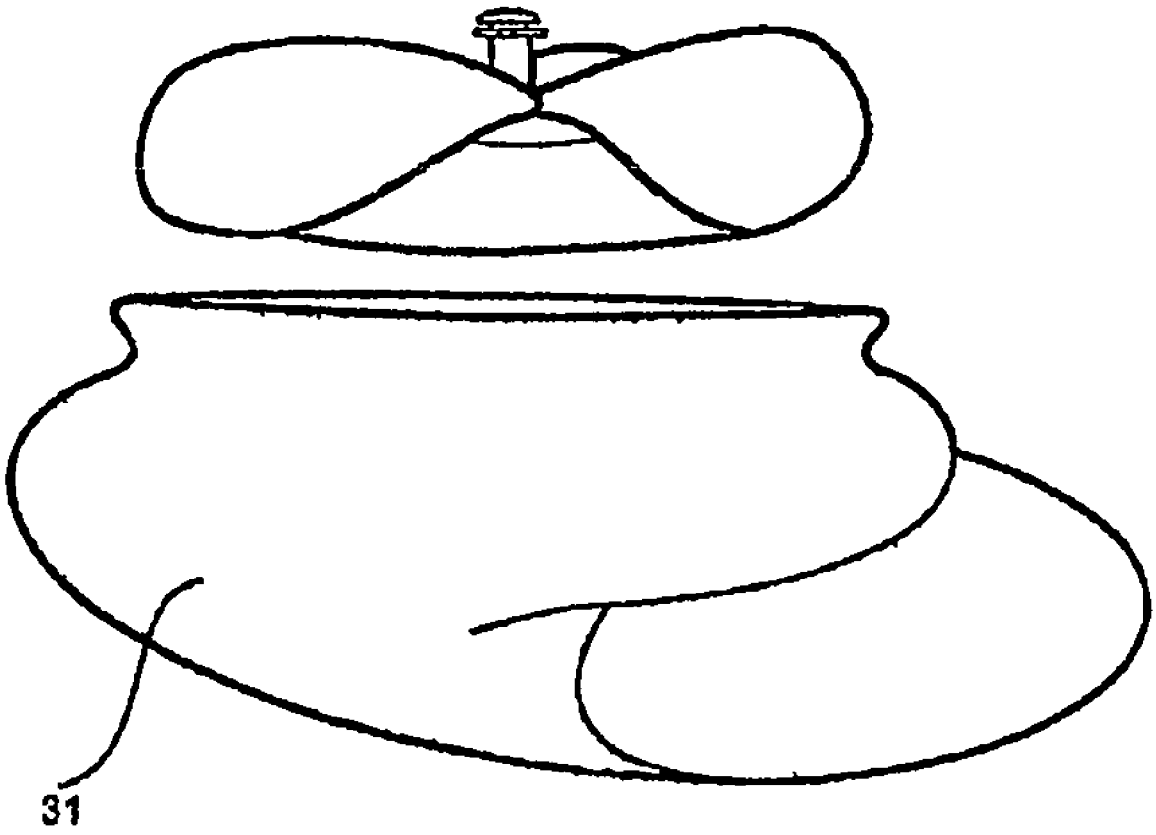
FIG. 6 is an exploded view of a fan according to a second embodiment.
Figure 7:
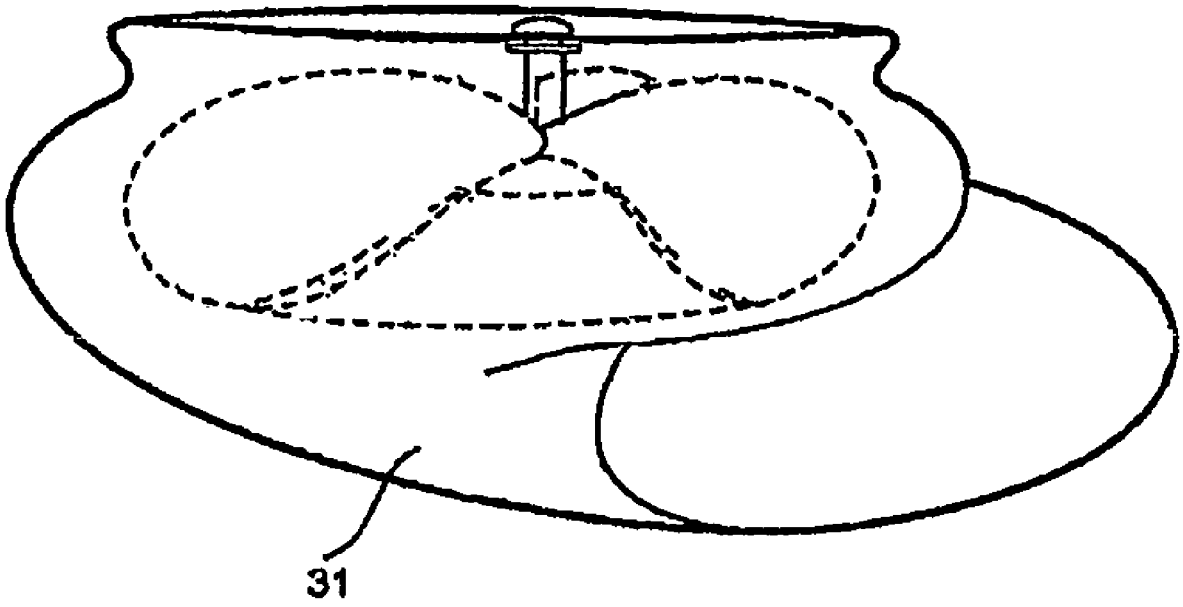
FIG. 7 is an isometric view of the fan of FIG. 6, showing the location of the rotor within the housing in dotted lines.

In a second embodiment, as shown in FIGS. 6 and 7, the first embodiment is adapted so that the housing 31 may be manufactured as a single piece, for example, by rota-moulding. Alternatively, the housing may comprise more than two portions.

Figure 8:
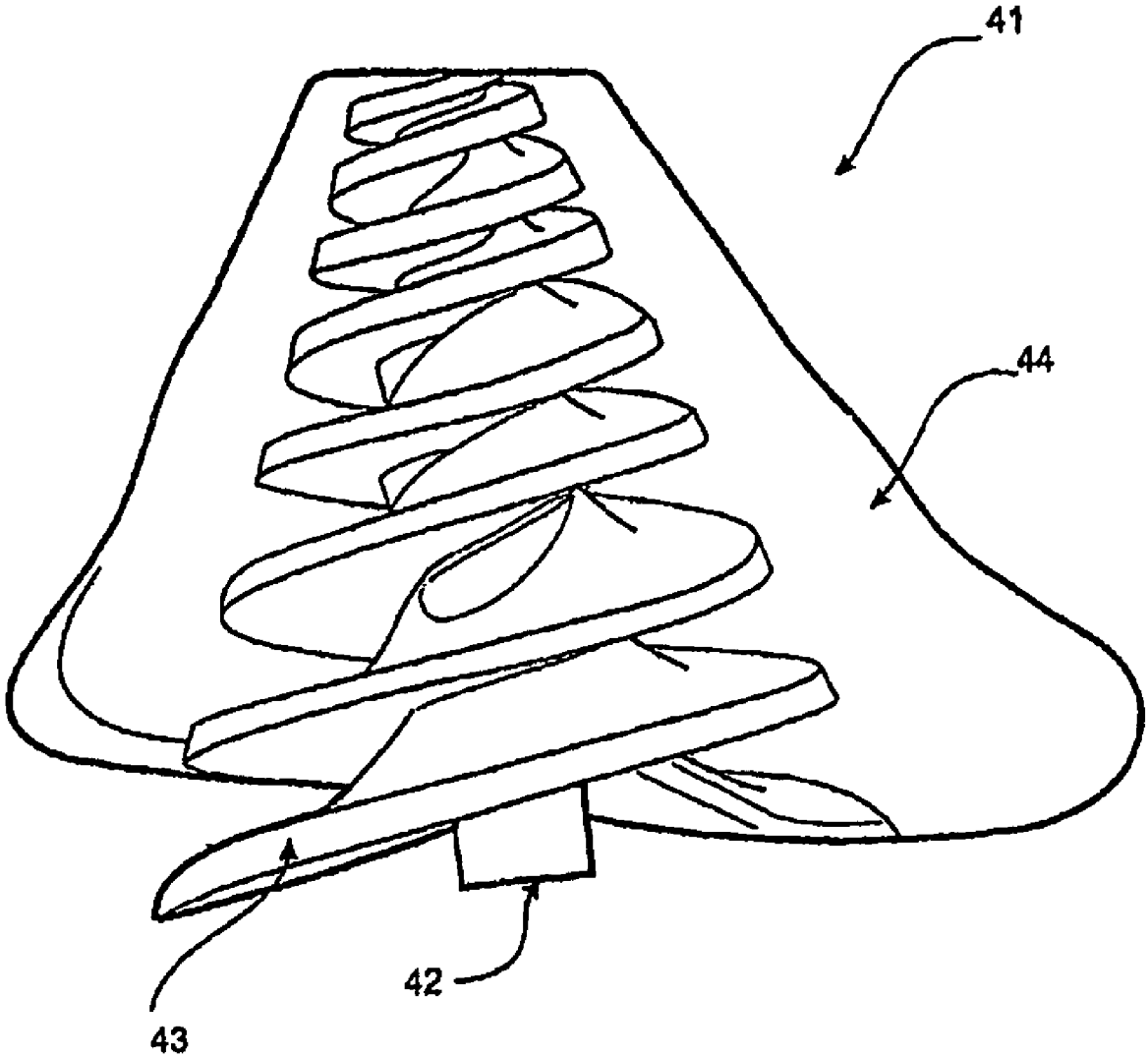
FIG. 8 is a diagrammatic cut-away of a fan according to a third embodiment.

FIG. 8 depicts a third embodiment of a fan 41 comprising a rotor 42 having a single vane 43 having an expanding screw-like form. This rotor 42 is accommodated within an extended housing 44, which nevertheless takes a vortical form. It is envisioned that such a design may be appropriate for more viscous fluids or fluid-like materials.

While a housing according to the first and second embodiments will provide improved performance when used with rotors having a wide range of vane configurations, it is to be appreciated that performance of the fan assembly will also depend on the configuration of the rotor. It has been found that performance may be further improved where the rotor itself is designed to provide flow in accordance with the principles of nature. Such a rotor is described in the applicants co-pending application entitled "Vortical Flow Rotor." It is to be understood that such a rotor is directed to providing a vortical flow stream, and when appropriately configured in conjunction with a housing according to the first or second embodiment, an optimized performance characteristic can be achieved.

It can be understood in light of the above description that a housing according to the first and second embodiments will provide performance improvements where a centrifugal rotor is used. As mentioned in relation to FIG. 5, it can be seen that the application of a radial component of fluid flow to the flow stream, will urge fluid outwardly as well as rotationally, thereby adopting a vortical flow. It is not so obvious that use of a housing of the first embodiment with an axial fan will also provide a significant performance improvement, yet this has been found to be the case. It seems that the provision of a housing that easily accommodates vortical flow promotes such vortical flow in practice. Therefore, it is within the cope of the invention now disclosed that the housing may be used with a rotor axial configuration.

This discovery has led to a further advance. The vanes of the rotor that can be used within the housing of the first embodiment may be configured with a profile that is intermediate between an axial and a centrifugal rotor. As mentioned earlier, axial and centrifugal rotors have quite differing performance characteristics: the axial rotor promoting high flow at low pressure while the centrifugal rotor promotes low flow at high pressure. By selecting a rotor with an intermediate characteristic, the performance of the fan can be "tailored" to more precisely match the application. The precise configuration of the housing may also be "tuned" to cooperate fully with the selected rotor to even further improve the design characteristics. Such flexibility has not been appreciated previously.

A designer can now approach a project knowing that he can properly design an appropriate fan for the task, rather than adopting an inappropriate fan due to physical constraints.

Additionally, it has been found that the compound curves of the housing of the above embodiments have rigidity and structural integrity considerably beyond flat sided panels found in conventional housings and thereby can be built from lighter and thinner materials. Nevertheless, the inherent stiffness, combined with the lack of turbulence within the fluid flow also reduce noise—a major problem in conventional housings. Flat-sided housings vibrate, drum, resonate, and amplify noise. The housing of the embodiments reduces vibration, drumming, resonance, and amplification of noise.

While it is believed that a fan having superior performance will generally be achieved by designing the housing in a three-dimensional vortical form as described in relation to the first embodiment, there will be instances where it will not be practicable to adopt such a form. This is more likely to be the case where the fan is to be used in an existing installation that has previously incorporated a conventional centrifugal fan. Nevertheless, significant improvements can be obtained by incorporating into the design of a conventional centrifugal fan the principles revealed in the first embodiment.

Figure 9:
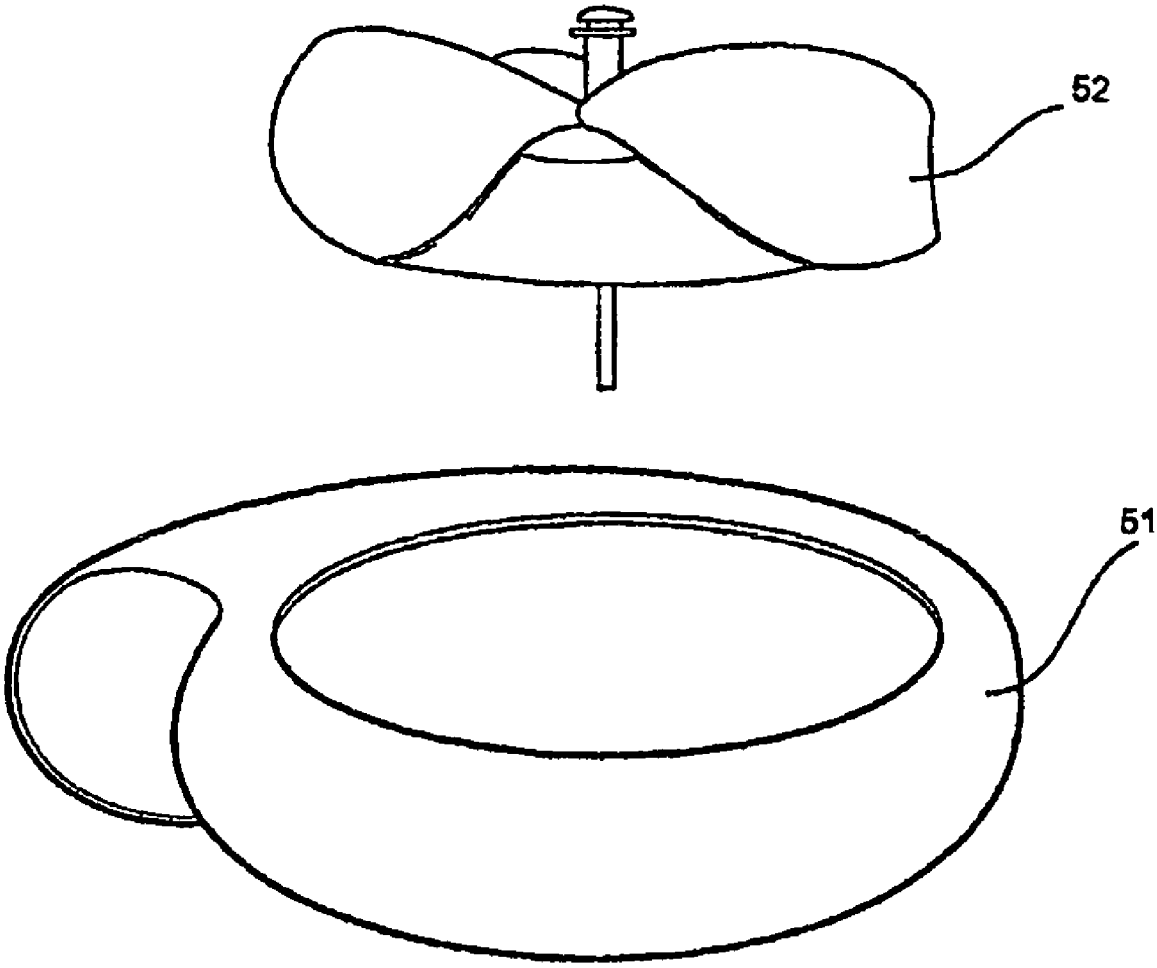
FIG. 9 is an isometric exploded view of a fan according to a fourth embodiment.

FIG. 9 shows a fourth embodiment comprising a housing 51 adapted to receive a fan rotor 52, constructed as closely as possible in accordance with the principles described above. As shown in the embodiment, the housing is somewhat similar in form to a conventional housing as shown in FIG. 1, but is altered modified in design to adopt the natural flow principles. This fan is configured according to a two dimensional logarithmic spiral conforming to the Golden Ratio. Further, the internal surfaces are curved with a curvature configured in accordance with the Golden Section. Such a configuration has been found to provide considerably improved efficiencies compared with the conventional housing of FIG. 1.

Figure 10:
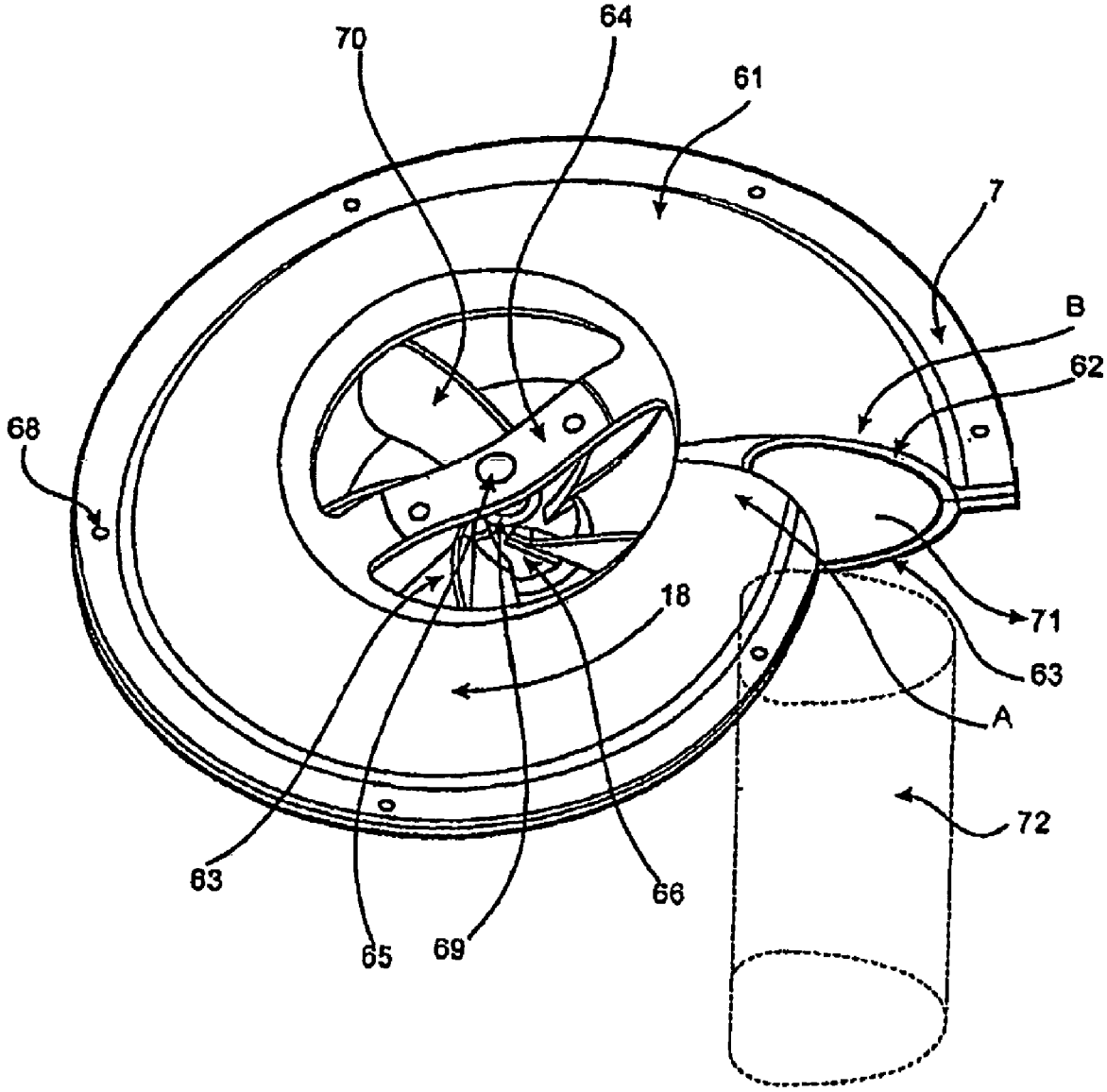
FIG. 10 is an isometric view of a fan according to a fifth embodiment.
Figure 11:
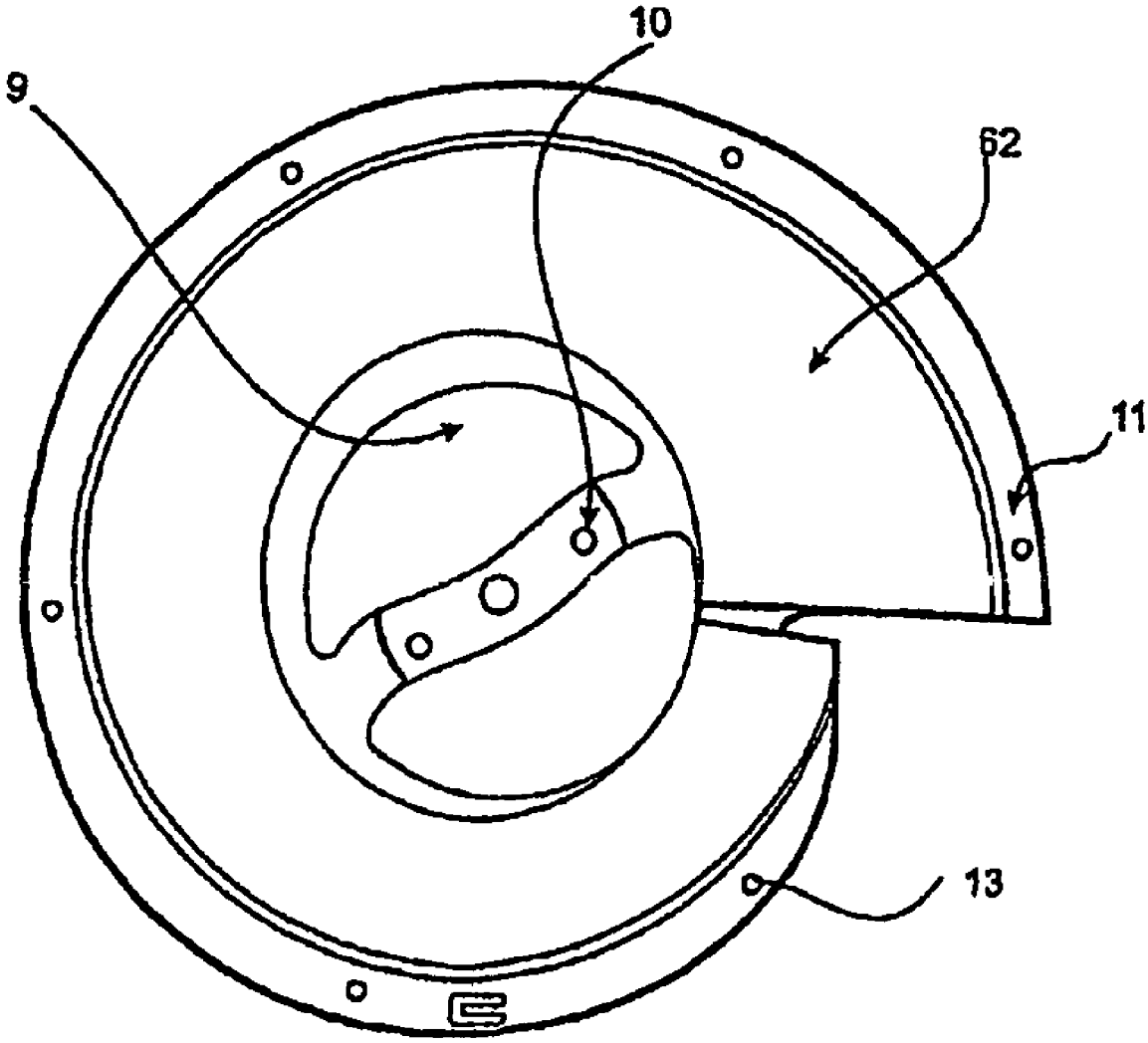
FIG. 11 is a plan view of the fan shown in FIG. 10.

FIGS. 10 and 11 show a fifth embodiment of a fan that has adopted the features of the fourth embodiment in a very practical design. As shown in FIGS. 10 and 11, the fan comprises a housing 61 which comprising two halves, a first half 62 and a second half 63, each of corresponding spiraling form. The first half 62 is provided with a centrally-located, circular inlet opening 63 which includes a support member 64 adapted to support the shaft 65 of a fan motor 66. The second half 63 has corresponding supporting means adapted to support the motor 66. The first 62 and second 63 halves each have corresponding flanges 67 around their perimeters with apertures 68 which enable the halves to be secured together easily by bolts or similar securing means (not shown). The motor 66 drives an impeller 69 having vanes 70 mounted on the motor shaft 65.

When assembled together, the first and second halves provide a fluid space between the internal surface of the housing and the imaginary surface swept by the outer edges of the vanes 13 during rotation of the impeller 69. This space increase from a minimum at a point "A" to a maximum at an adjacent point "B."

At the maximum point "B" the housing incorporates an outlet opening 71 transverse to the plane of rotation of the impeller which is co-planar with the axis. In use an outlet duct 72 (as shown in dotted lines) will normally be mounted to the outlet to convey the fluid from the housing.

The walls of the two halves around the space are curved with a curvature which substantially conforms with the Golden Section. This curvature is also be configured to cause the fluid to flow within the space in a spiraling, vortical motion. As a result, drag in the fluid flow through the space is reduced.

This drag reduction minimizes vibration, resonance, back pressure, turbulence, drumming, noise and energy consumption and efficiency is improved in comparison to a conventional fan of the type shown in FIG. 1.

It has also been found to be advantageous that this space increases at a logarithmic rate conforming to the Golden Ratio.

Figure 12:
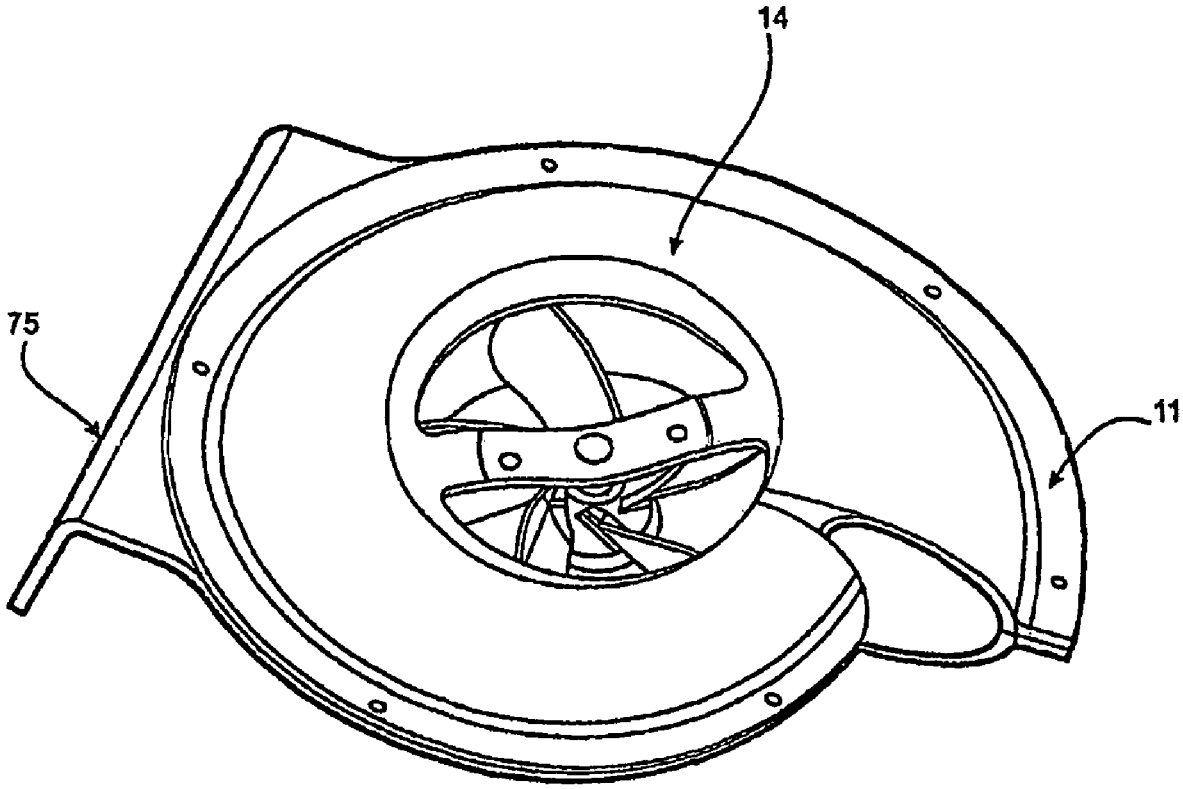
FIG. 12 is an isometric view of a fan according to a sixth embodiment.
Figure 13:
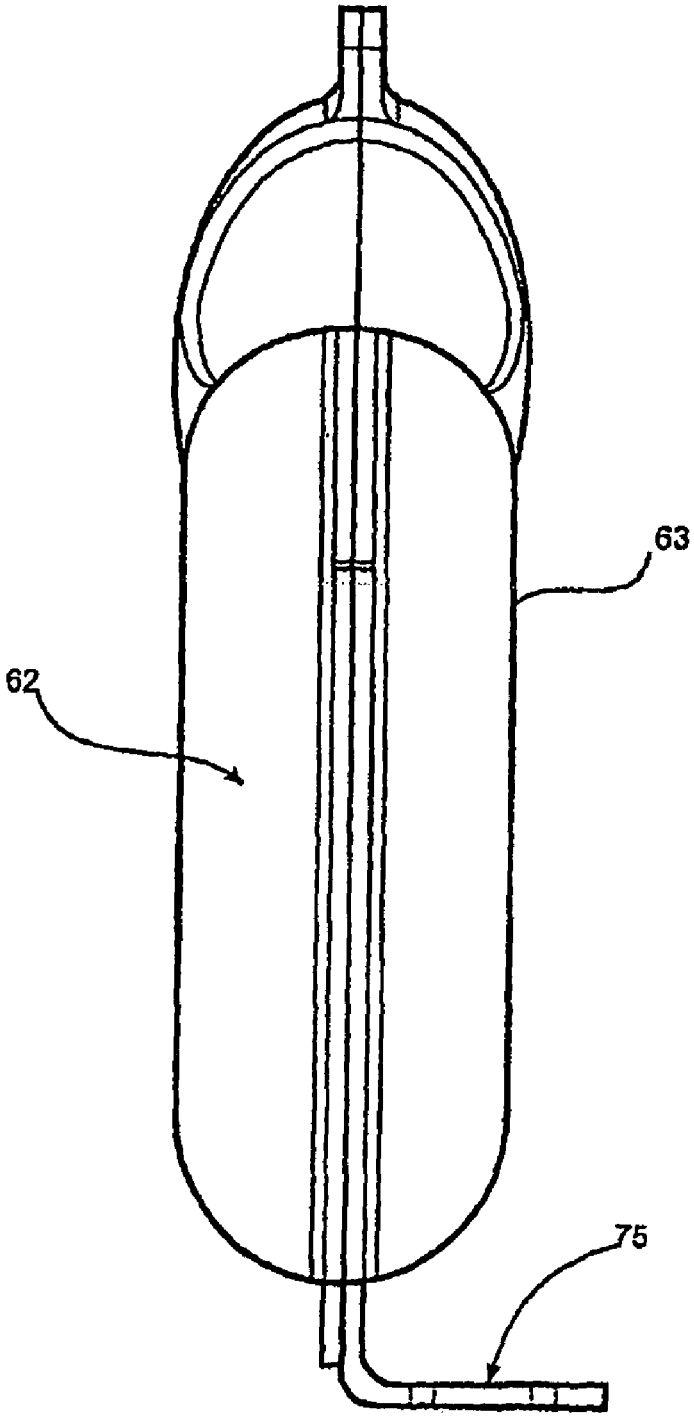
FIG. 13 is a side view of the fan shown in FIG. 12.

The fifth embodiment may be adapted further. A sixth embodiment is shown in FIGS. 12 and 13 which incorporates a suitable mounting bracket 75. In other respects, the embodiment is the identical to that of the fifth embodiment and therefore in the drawings, like numerals are used to depict like features of the fifth embodiment.

Throughout the specification, unless the context requires otherwise, the word "comprise" or variations such as "comprises" or "comprising," will be understood to imply the inclusion of a stated integer or group of integers but not the exclusion of any other integer or group of integers.

What is claimed is:

1. A housing for a rotor, the housing comprising:

an interior cavity;

an inlet portion for guiding a rotor propelled fluid into the interior cavity;

an outlet portion that exhausts the fluid from the interior cavity of the housing, the outlet portion axially extending from the inlet portion and away from a region of rotation of the rotor, wherein adjoining sections of the inlet portion and the outlet portion conform in cross section so that the inlet portion and the outlet portion both form a continuation of the interior cavity, and wherein the interior cavity promotes vortical flow of the fluid by conforming to the streamlines of a three dimensional vortex.

2. The housing of claim 1, wherein the configuration of the interior cavity conforms to a three-dimensional spiral.

3. The housing of claim 1, wherein the interior cavity includes an active surface that guides the fluid flowing within the housing, the active surface conforming substantially to a logarithmic spiral.

4. The housing of claim 3, wherein the logarithmic spiral unfolds at a constant order of growth when measured at equiangular radii.

5. The housing of claim 1, wherein the interior cavity includes an active surface configured to cooperate with the fluid flowing within the housing, the active surface having a configuration conforming substantially to that of a logarithmic curve.

6. The housing of claim 5, wherein the logarithmic curve unfolds at a constant order of growth when measured at equiangular radii.

7. The housing of claim 1, wherein the outlet portion extends a flow path for a fluid in a continuous manner from the inlet portion.

8. The housing of claim 1, wherein the interior cavity surrounds at least the perimeter of the rotor and provides a space between an inner surface of the interior cavity and a surface swept by an outer edge of at least one vane of the rotor during rotation of the rotor.

9. The housing of claim 8, wherein the space increases from a minimum cross-sectional area to an expanded cross-sectional area.

10. The housing of claim 1, wherein the inlet portion includes a mount to support the rotor.

11. The housing of claim 1, wherein the flow of the fluid is redirected by the interior cavity in a generally transverse direction relative to the incoming flow.

12. The housing of claim 1, wherein the interior cavity includes a component separate from an external surface of the housing.

13. The housing of claim 1, wherein a profile of the housing conforms to a profile of the rotor.

14. The housing of claim 13, a wherein the profile of the rotor is that of an axial rotor.

15. The housing of claim 13, a wherein the profile of the rotor is that of a centrifugal rotor.

16. The housing of claim 13, wherein the profile of the rotor is intermediate to that of an axial rotor and that of a centrifugal rotor.

17. A rotor housing apparatus for, comprising:

an inner cavity enclosing a region of rotation for a rotor;

an inlet located on a first portion of the rotor housing;

an outlet located on a second portion of the rotor housing, the second portion of the rotor housing being approximately opposed with respect to the first portion of the rotor housing, adjoining sections of the first and second portions conforming in cross section so that the second portion forms a continuation of the first portion, and wherein an internal surface of the rotor housing includes a vortical formation that induces a vortical flow in a fluid traversing a fluid pathway between the inlet and the outlet.

18. The rotor housing apparatus of claim 17, wherein the rotor is a centrifugal rotor.

19. The rotor housing apparatus of claim 17, wherein the rotor is an axial rotor.

* * * * *